US006860340B2

(12) United States Patent
Rodert

(10) Patent No.: US 6,860,340 B2
(45) Date of Patent: Mar. 1, 2005

(54) ROCK DRILLING MACHINE

(75) Inventor: Jörgen Rodert, Saltsjö-Boo (SE)

(73) Assignee: Atlas Copco Rock Drills AB, Orebro (SE)

( * ) Notice: Subject to any disclaimer, the term of this patent is extended or adjusted under 35 U.S.C. 154(b) by 0 days.

(21) Appl. No.: 10/398,792

(22) PCT Filed: Oct. 19, 2001

(86) PCT No.: PCT/SE01/02286

§ 371 (c)(1),
(2), (4) Date: Apr. 8, 2003

(87) PCT Pub. No.: WO02/36926

PCT Pub. Date: May 10, 2002

(65) Prior Publication Data

US 2004/0026098 A1 Feb. 12, 2004

(30) Foreign Application Priority Data

Nov. 2, 2002 (SE) ..... 0004002

(51) Int. Cl.[7] ..... B25D 1/04

(52) U.S. Cl. ..... 173/104; 173/128; 173/171; 173/206

(58) Field of Search ..... 173/128, 171, 173/104, 108, 114, 206

(56) References Cited

U.S. PATENT DOCUMENTS

| | | | | |
|---|---|---|---|---|
| 3,666,022 A | | 5/1972 | Bailey et al. | |
| 5,155,539 A | * | 10/1992 | Yamaguchi et al. | 399/317 |
| 5,542,479 A | * | 8/1996 | Stachler et al. | 173/90 |
| 5,810,776 A | * | 9/1998 | Bacich et al. | 604/131 |
| 6,109,620 A | | 8/2000 | Roberts et al. | |

FOREIGN PATENT DOCUMENTS

| | | | | |
|---|---|---|---|---|
| DE | 19638464 | | 3/1998 | |
| EP | 0198809 | | 10/1988 | |
| EP | 904891 A2 | * | 3/1999 | B23Q/1/42 |

* cited by examiner

*Primary Examiner*—Stephen F. Gerrity
(74) *Attorney, Agent, or Firm*—Mark P. Stone

(57) ABSTRACT

A rock drilling machine has a housing (1), a hammer piston (2) movable to-and-fro in the housing, a drilling tool (3), and a guide (4) for the drilling tool. The guide (4) consists at the surface against the drilling tool (3) of polyethyleneterephthalate.

1 Claim, 1 Drawing Sheet

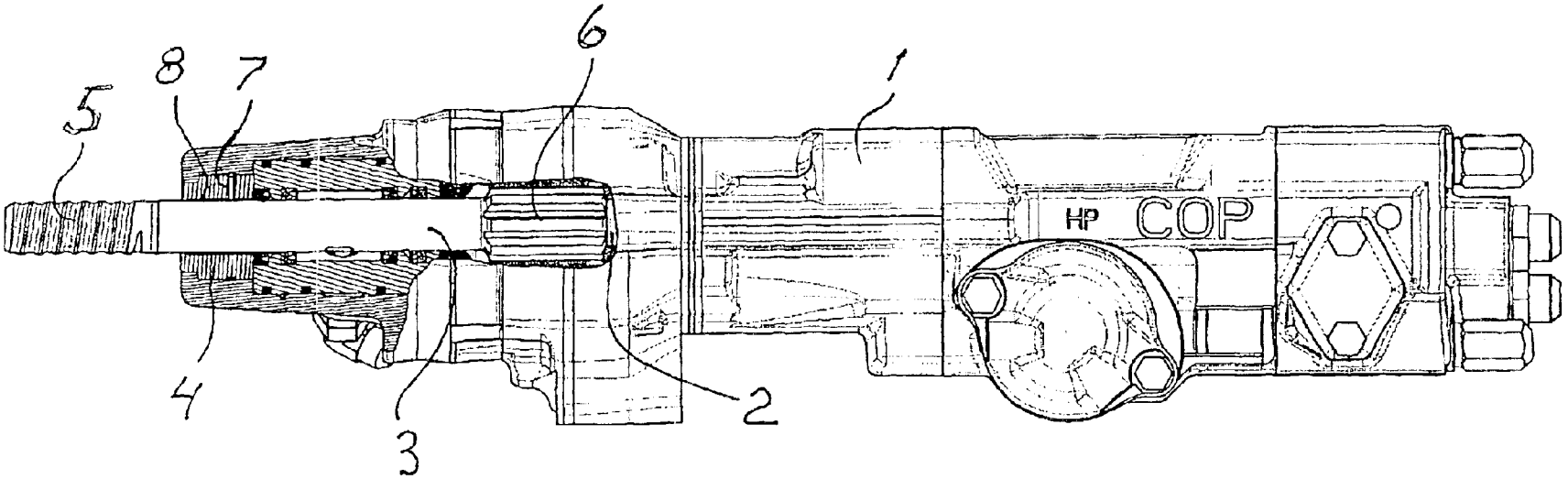
HP COP
1
2
3
4
5
6
7
8

ROCK DRILLING MACHINE

The present invention relates to a rock drilling machine and more particularly to a rock drilling machine provided with a special guide for the drilling tool.

In previously known rock drilling machines one uses a guide for the drilling tool made of a bronze material. A problem with this solution is that there often occurs seizure between the bronze guide and the drilling tool which is made of steel. This then results in cracks and breakage of the drilling tool.

The present invention, which is defined in the subsequent claim, aims at avoiding the above mentioned problem. This is achieved by making the guide with a surface against the drilling tool consisting of polyethyleneterephthalate.

An embodiment of the invention is described below with reference to the accompanying drawing which shows a rock drilling machine according to the invention, partly in section.

The rock drilling machine shown in the drawing comprises a housing 1 in which a hammer piston 2 is movable to-and-fro to exert a drilling tool 3 to impacts. Only the rear part of the drilling tool, the shank adapter, is shown. The shank adapter is provided with a thread 5 for connection of the rest of the drilling tool and a cog-shaped part 6 for rotating the drilling tool. In the front part of the rock drilling machine a guide 4 for the drilling tool is arranged. The guide 4 is made of polyethyleneterephthalate. It is, however, sufficient to make the surface against the drilling tool 3 of polyethyleneterephthalate. The guide 4 is provided with a number of radial bores 7 and adjacent the bores longitudinal grooves 8. By means of these one obtains a leakage flow distributed about the drilling tool 3 from the inner of the rock driling machine to prevent drill cuttings and other impuities from entering into the rock drilling machine.

What is claimed is:

1. Rock drilling machine comprising a housing (1), a hammer piston (2) movable to-and-fro in the housing, a drilling tool (3), and a guide (4) for guiding the drilling tool, the hammer piston being intended for exerting the drilling tool to impacts, characterized in that the guide (4), at least at the surface against the drilling tool (3), is made of polyethyleneterephthalate.

* * * * *